US006927654B2

(12) United States Patent
Huynh et al.

(10) Patent No.: US 6,927,654 B2
(45) Date of Patent: Aug. 9, 2005

(54) CORROSION RESISTANT WAVEGUIDE SYSTEM AND METHOD

(75) Inventors: Mel V. Huynh, Canoga Park, CA (US); Carl W. Townsend, Los Angeles, CA (US); Phillip G. Magallanes, La Mirada, CA (US)

(73) Assignee: Raytheon Company, Waltham, MA (US)

( * ) Notice: Subject to any disclaimer, the term of this patent is extended or adjusted under 35 U.S.C. 154(b) by 69 days.

(21) Appl. No.: 10/375,311

(22) Filed: Feb. 26, 2003

(65) Prior Publication Data

US 2004/0164823 A1 Aug. 26, 2004

(51) Int. Cl.[7] ..... H01P 3/12

(52) U.S. Cl. ..... 333/239; 333/248

(58) Field of Search ..... 333/73 W, 95 R, 333/98 R, 239, 248

(56) References Cited

U.S. PATENT DOCUMENTS

| | | | | | |
|---|---|---|---|---|---|
| 3,716,869 | A | * | 2/1973 | Gould et al. | 343/779 |
| 3,982,215 | A | * | 9/1976 | Lo et al. | 333/208 |
| 4,654,613 | A | * | 3/1987 | Fischer | 333/256 |
| 5,198,828 | A | * | 3/1993 | West et al. | 343/776 |
| 5,739,734 | A | * | 4/1998 | Chen et al. | 333/210 |
| 5,763,824 | A | * | 6/1998 | King et al. | 174/35 R |
| 6,181,220 | B1 | | 1/2001 | Meder | |
| 6,265,703 | B1 | | 7/2001 | Alton | |

FOREIGN PATENT DOCUMENTS

| | | | |
|---|---|---|---|
| JP | 359074704 | * | 4/1984 |

* cited by examiner

*Primary Examiner*—Dinh T. Le
(74) *Attorney, Agent, or Firm*—Leonard A. Alkov; Karl A. Vick

(57) ABSTRACT

A waveguide device that includes a waveguide device body having interior surfaces, a deposited aluminum coating disposed on the interior surfaces of the waveguide device body, a protective coating disposed on the deposited aluminum coating.

38 Claims, 1 Drawing Sheet

CORROSION RESISTANT WAVEGUIDE SYSTEM AND METHOD

TECHNICAL FIELD OF THE DISCLOSURE

The disclosure is generally directed to microwave waveguide devices, and more particularly to techniques for reducing corrosion due to electrical arcing.

BACKGROUND OF THE DISCLOSURE

Microwave waveguide devices are employed in variety of applications such as radar and RF communications. Waveguide devices are typically formed of metal, and electrical arcing can occur, for example at relatively high power levels. Arcing is believed to cause corrosion of the interior surfaces of waveguide devices, and corrosion product buildup can subsequently cause failure.

Accordingly, there is a need to reduce corrosion in waveguide devices.

SUMMARY OF THE DISCLOSURE

The disclosed waveguide device includes a waveguide device body having an interior surface, a deposited aluminum coating deposited on the interior surface of the waveguide device body, a protective coating deposited on the deposited aluminum coating.

BRIEF DESCRIPTION OF THE DRAWING

Features and advantages of the disclosure will become more apparent from the following detailed description of exemplary embodiments, as illustrated in the accompanying drawings, in which.

DETAILED DESCRIPTION OF THE DISCLOSURE

The disclosed waveguide device structures include a composite coating that can help to reduce corrosion that is believed to result from arcing. The corrosion product found in aluminum waveguides is primarily aluminum nitrate, and is believed to be formed by an arcing process, with nitric acid as an intermediate product. Chemically, the process can be summarized as three sequential chemical reactions:

| | | |
|---|---|---|
| 1) Nitrogen Fixing: | $20_2 + N_2$ + arc | $2N0_2$ |
| 2) Acid Formation: | $3N0_2 + H_20$ | $2HN0_3 + N0$ |
| 3) Corrosion: | $Al + 6HNO_3 + xH_20$ | $Al(N0_3)_3$ * $(x + 3)H_20 + 3N0_2$ |

Aluminum waveguides have in the past been coated with chromate conversion coating. However, the interior surfaces were relatively rough. At high power levels, arcing is initiated on protruding surfaces, typically rough areas at braze joints. Arcing in turn causes the formation of nitric acid. The nitric acid attacks first the chromate film, and subsequently the aluminum surface. Corrosion product buildup can subsequently cause failure of rotating components such as waveguide switches.

Prior attempts to solve the problem have included the use of silver or gold plating to enhance the corrosion protection while simultaneously improving conduction of microwave energy. Since silver is rapidly attacked by nitric acid, these systems are prone to corrosion. Due to its high galvanic mismatch with aluminum, gold plating initiates undercutting in pinhole defects.

The disclosed composite coating which comprises deposited aluminum coating and an overlying chromate conversion coating are believed to protect the waveguide device body from the nitric acid.

Figure 1:
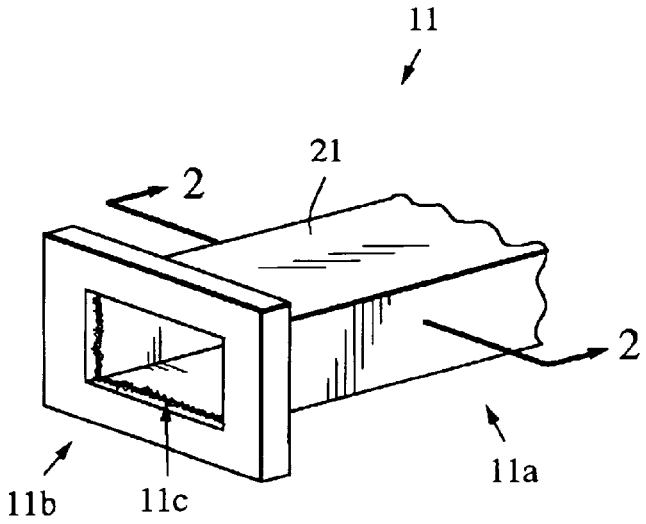
FIG. 1 is a schematic perspective view of an embodiment of a waveguide device that includes interior surfaces having a protective coating.
Figure 2:
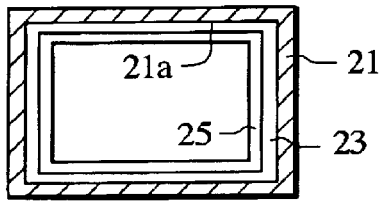
FIG. 2 is a schematic sectional view of the waveguide device of FIG. 1.

FIG. 1 is a schematic perspective view and FIG. 2 is a sectional view of an embodiment of a waveguide device 11 that includes an energy conducting portion 11*a* and a connector portion 11*b*. The energy conducting portion 11*a* can comprise a waveguide section, for example, while the connector portion 11*b* can comprise a flange that is attached to the guide section by brazed solder joints 11*c*, for example. The solder joints 11*c* can be smoothed by electropolishing, mechanical polishing and/or chemical milling.

The waveguide device 11 more particularly includes a body 21 having interior surfaces 21*a*. The body 21 can be formed of any suitable waveguide material such as type 6061 aluminum, for example. A deposited aluminum layer or coating 23 is disposed on the interior surfaces 21*a* and at least those portions of the solder joints 11*c* that would be in the interior of the waveguide circuit in which the waveguide device 11 is utilized. More generally, the deposited aluminum coating can be on surfaces of the waveguide device that would otherwise be subjected to electrical arcing generated nitric acid in the absence of the deposited aluminum coating 23. The deposited aluminum coating 23 can have a thickness in the range of 0.0001 inch to about 0.002 inch. By way of specific example, the deposited aluminum coating can have a thickness of about 0.0016 inches. A chromate conversion coating 25 is disposed on the deposited aluminum coating 23.

The aluminum coating 23 and the chromate conversion coating 25 comprise a composite protective coating that can reduce corrosion of the waveguide device body caused by electrical arcing. The deposited aluminum layer, e.g. deposited using an ion vapor deposition process, has the advantage that it substantially matches the galvanic potential of 6061 aluminum, and the conversion film seems to effectively fill the porosity of the aluminum layer, both shutting off the point of exposure and providing a significant reservoir of additional chromate material.

Figure 3:
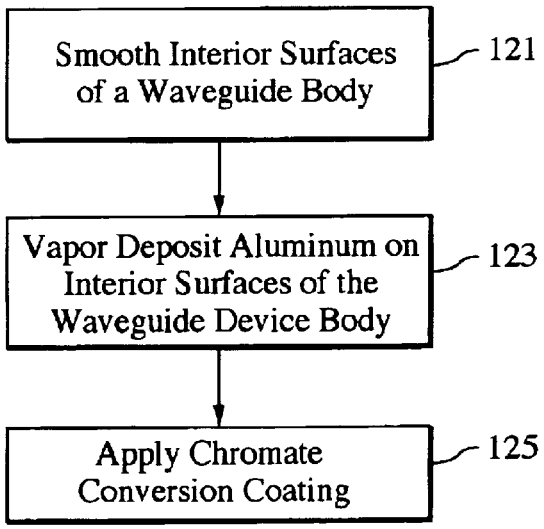
FIG. 3 is a flow diagram of an embodiment of a process for making a waveguide device having coated interior surfaces.

FIG. 3 is a flow diagram of an embodiment of a process for making a coated waveguide device such as those illustrated in FIGS. 1 and 2. At 121 interior surfaces of a waveguide device body are smoothed, for example by electropolishing, mechanical polishing and/or chemical milling. Such smoothing can reduce arcing. At 123 an aluminum coating is deposited on interior surfaces of the waveguide device body, for example by ion vapor deposition. Other techniques such as electroplated aluminum can alternately be employed, although ion vapor deposition is a preferred technique. The aluminum coating 23 can also be deposited on solder regions as deemed appropriate.

At 125 a chromate conversion coating is applied over at least the aluminum coating. For example, the chromate conversion coating can be applied over the entire microwave device by immersion in a chromic acid solution, as is known in the art.

In use, damage and/or corrosion due to electrical arcing can be further reduced by operating the waveguide device in conditions that reduce arcing. For example, lower power levels have been observed to reduce arcing. Also, since the corrosive arcing process described previously requires water to form nitric acid, reducing humidity in a waveguide device could reduce the formation of nitric acid which in turn would reduce corrosion. This could be done by circulating dry gas within the entire waveguide structure, or by desiccation.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A waveguide device comprising:

a waveguide device body having an electrically conductive interior surface;

a deposited aluminum coating disposed on said electrically conductive interior surface; and a protective coating disposed on said deposited aluminum coating.

2. The waveguide device of claim 1 wherein said deposited aluminum coating comprises a vapor deposited aluminum coating.

3. The waveguide device of claim 1 wherein said protective coating comprises a chromate conversion coating.

4. The waveguide device of claim 1 wherein said waveguide device body is fabricated of 6061 aluminum.

5. The waveguide device of claim 4 wherein said deposited aluminum coating comprises a vapor deposited aluminum coating.

6. The waveguide device of claim 4 wherein said protective coating comprises a chromate conversion coating.

7. The waveguide device of claim 1, wherein the deposited aluminum coating has a thickness in a range from about 0.0001 inch to about 0.002 inch.

8. A waveguide device comprising:

a waveguide device body having an electrically conductive interior surface;

an ion vapor deposited aluminum coating disposed on said electrically conductive interior surface; and a chromate conversion coating disposed on said deposited aluminum coating.

9. A The waveguide device of claim 8 wherein the waveguide device body is fabricated of 6061 aluminum.

10. A method of making a waveguide device comprising:

depositing an aluminum coating on an electrically conductive interior surface of a waveguide device body; and applying a protective coating on the deposited aluminum coating.

11. The method of claim 10 wherein depositing an aluminum coating comprises vapor depositing an aluminum coating on the electrically conductive interior surface of the waveguide device body.

12. The method of claim 10 wherein applying a protective coating comprises chromate conversion coating the deposited aluminum coating.

13. A waveguide device made in accordance with the method of claim 10.

14. A method of making a waveguide device comprising:

ion vapor depositing an aluminum coating on an electrically conductive interior surface of a waveguide device body; and chromate conversion coating the deposited aluminum coating.

15. The method of claim 14 wherein the waveguide device is fabricated of 6061 aluminum.

16. A waveguide device made in accordance with the method of claim 14.

17. A method of making a waveguide device comprising:

smoothing solder joints of a waveguide device body;

depositing an aluminum coating on an electrically conductive interior surface of the waveguide device body; and applying a protective coating on the deposited aluminum coating.

18. The method of claim 17 wherein smoothing solder joints comprises smoothing braze joints.

19. The method of claim 17 wherein depositing an aluminum coating comprises ion vapor depositing an aluminum coating on an electrically conductive interior surface of the waveguide device body.

20. The method of claim 17 wherein applying a protective coating comprises chromate conversion coating the deposited aluminum coating.

21. A waveguide device made in accordance with the method of claim 17.

22. A method of reducing corrosion of a waveguide device comprising:

depositing an aluminum coating on selected electrically conductive surfaces of a waveguide device body;

applying a protective coating on the deposited aluminum coating; and operating the waveguide device at electrical power conditions that reduce arcing.

23. The method of claim 22 further including reducing humidity in the waveguide device.

24. The method of claim 22 wherein said applying a protective coating comprises applying a chromate conversion coating.

25. The method of claim 22 wherein the waveguide device is fabricated of aluminum.

26. A waveguide device comprising:

a waveguide body having an interior surface, wherein the waveguide body is fabricated of aluminum and the interior surface comprises aluminum;

a deposited aluminum coating disposed on said interior surface; and a protective coating disposed on said deposited aluminum coating.

27. The waveguide device of claim 26 wherein said deposited aluminum coating comprises a vapor deposited aluminum coating.

28. The waveguide device of claim 26 wherein said protective coating comprises a chromate conversion coating.

29. The waveguide device of claim 26 wherein said waveguide device body comprises 6061 aluminum.

30. The waveguide device of claim 29 wherein said deposited aluminum coating comprises a vapor deposited aluminum coating.

31. The waveguide device of claim 29 wherein said protective coating comprises a chromate conversion coating.

32. A method of making a waveguide device comprising:

ion vapor depositing an aluminum coating on an interior surface of a waveguide device body, wherein the waveguide device body comprises aluminum; and chromate conversion coating the deposited aluminum coating.

33. A waveguide device comprising:

a conductive waveguide body having an electrically conductive interior surface; and a composite coating disposed on said electrically conductive interior surface, wherein the composite coating comprises a deposited aluminum coating and an overlying chromate conversion coating.

34. The waveguide device of claim 33 wherein said deposited aluminum coating comprises a vapor deposited aluminum coating.

35. The waveguide device of claim 33 wherein said conductive waveguide device body is fabricated of aluminum.

36. The waveguide device of claim 33 wherein said conductive waveguide body comprises 6061 aluminum.

37. The waveguide device of claim 33 wherein said deposited aluminum coating comprises a vapor deposited aluminum coating.

38. The waveguide device of claim 33 wherein said deposited aluminum coating has a thickness in a range from about 0.0001 inch to about 0.002 inch.

* * * * *